US005280296A

United States Patent [19]

Tan et al.

[11] Patent Number: 5,280,296

[45] Date of Patent: Jan. 18, 1994

[54] ANTENNA SYSTEM FOR A WRIST CARRIED SELECTIVE CALL RECEIVER

[75] Inventors: Wei L. Tan; Pha C. Nguyen, both of Lake Worth; Angel Bolanos, Boynton Beach, all of Fla.

[73] Assignee: Motorola, Inc., Schaumburg, Ill.

[21] Appl. No.: 875,487

[22] Filed: Apr. 29, 1992

[51] Int. Cl.[5] ..... H01Q 7/08

[52] U.S. Cl. ..... 343/718; 343/742

[58] Field of Search ..... 343/718, 741, 742, 744, 343/866, 867, 868, 870, 873; 455/351, 100, 274, 344, 347

[56] References Cited

U.S. PATENT DOCUMENTS

| | | | |
|---|---|---|---|
| 2,881,429 | 4/1959 | Radcliffe | 343/868 |
| 3,032,651 | 5/1962 | Stahli et al. | 343/718 |
| 3,582,951 | 6/1971 | Altmayer | 343/718 |
| 3,736,591 | 5/1973 | Rennels et al. | 343/702 |
| 4,313,119 | 1/1982 | Garay et al. | 343/702 |
| 4,713,808 | 12/1987 | Gaskill et al. | 370/94 |
| 4,801,944 | 1/1989 | Madnick et al. | 343/742 |
| 4,873,527 | 10/1989 | Tan | 343/718 |
| 4,922,260 | 5/1990 | Gaskill et al. | 343/718 |
| 5,189,431 | 2/1993 | Marinelli | 343/718 |

*Primary Examiner*—Donald Hajec
*Assistant Examiner*—Hoanganh Le
*Attorney, Agent, or Firm*—R. Louis Breeden; Thomas G. Berry; Daniel R. Collopy

[57] ABSTRACT

An antenna system (308, 309, 310, 312, 314, 316, and 317) for a wrist carried selective call receiver (300) comprises at least first (312 and 314) and second (310) elements, coupled to each other and coupled to the selective call receiver to form a first single magnetic loop antenna (312, 308, 316, and 310) having a first physical orientation. At least one of the first and second elements comprises at least one second single magnetic loop antenna (312, 308, 316, 310, 317, 309, and 314) also coupled to the selective call receiver. The second single magnetic loop antenna has a second physical orientation different from the first physical orientation.

18 Claims, 5 Drawing Sheets

ANTENNA SYSTEM FOR A WRIST CARRIED SELECTIVE CALL RECEIVER

FIELD OF THE INVENTION

This invention relates in general to radio frequency antenna systems, and more specifically to magnetic loop antennae for wrist carried receivers.

BACKGROUND OF THE INVENTION

In portable radio receivers and especially in selective call receivers and related applications, size and weight are extremely important factors. In the past, many selective call receivers have used antenna systems that have tended to increase the size and weight of the receivers significantly. As compactness and light weight have become more important in the design of modern selective call receivers, compact and light weight antenna systems also have become more important.

The need for small size and weight is particularly strong in a selective call receiver designed to be carried on the wrist. However, a degradation in antenna system performance to achieve size and weight reduction is not desirable. Furthermore, a wrist carried selective call receiver is operated in many different positions. It may be held in front of the face, at the side of the human body, outstretched from the body, or placed on various conducting and non-conducting surfaces. A wrist carried selective call receiver thus must be designed for acceptable receive sensitivity in many possible body positions.

Conventional wrist carried receivers have used serpentine loop antennae or simple loop antennae that are responsive to the magnetic field component of a transmitted radio frequency (RF) signal. One such antenna system is shown in U.S. Pat. No. 3,032,651 to Gisiger-Stahli et al. This type of antenna system provided marginal performance but was desirable because the antenna elements could be concealed within the wrist band housing. The performance of simple loop antennae was particularly poor for certain body positions in which the magnetic field of the transmitted RF signal was parallel to the plane of the loop.

An improvement to the single loop antenna design is shown in U.S. Pat. No. 4,873,527 to Tan. The improvement comprises a "combo" design incorporating a ferrite core loop antenna connected in series with a single magnetic loop antenna. The axes of the two antennae were orthogonal to one another, resulting in a reduction in susceptibility to performance variation caused by changes in body position. While the "combo" design performed better than the single loop design, there were size and weight tradeoffs that limited its performance. Because the ferrite core loop antenna had to fit within the housing of the selective call receiver, it had to be small and light. A small ferrite core antenna, though, would be less sensitive than one with a larger cross-sectional area. The result invariably was either a selective call receiver that was larger than desired, or a design whose susceptibility to performance variation caused by changes in body position was more than desired.

A further problem with the "combo" design resulted from the fact that the ferrite core loop antenna and the single magnetic loop antenna were connected in series. The single magnetic loop antenna consisted of two elements that became separated whenever the wrist-band clasp was opened, e.g., to remove the wrist carried selective call receiver. Opening the clasp would thus also open the entire antenna system, substantially reducing its performance. Reduced performance with the clasp open is undesirable in the wrist carried selective call receiver, because some users might want to continue operating the selective call receiver while not actually wearing it about the wrist.

What therefore is needed is an antenna system for a wrist carried selective call receiver that eliminates the space consuming ferrite core loop antenna while maintaining antenna performance in many possible body positions. An antenna system that continues to function when the selective call receiver is removed from the wrist with the clasp open also is desirable.

SUMMARY OF THE INVENTION

One aspect of the present invention is an antenna system for a wrist carried selective call receiver comprising a non-conducting housing formed as a substantially cylindrical band for surrounding the wrist. The band is delimited by first and second outer edges. The antenna system comprises a first member for coupling to a radio frequency (RF) input of the selective call receiver and a second member for coupling to a ground node of the selective call receiver. The antenna system further comprises a first element positioned near the first outer edge of the band and coupled to the first member and to the second member to form a first single magnetic loop antenna which encircles the wrist, and a second element positioned near the second outer edge of the band, the second element coupled to the first element and coupled to the first member and to the second member to form a second single magnetic loop antenna orthogonal to the first single magnetic loop antenna.

Another aspect of the present invention is a wrist carried selective call receiver having a non-conducting housing formed as a substantially cylindrical band for surrounding the wrist, the band delimited by first and second outer edges. The selective call receiver comprises a receiver element for receiving radio frequency (RF) signals comprising information and for demodulating the RF signals to derive the information. The receiver element comprises an RF input for receiving the radio frequency signals, and a ground node for providing a ground reference for the wrist carried selective call receiver. The selective call receiver further comprises an antenna element coupled to the receiver element for accepting the RF signals and providing the RF signals to the receiver element. The antenna element comprises a first element positioned near the first outer edge of the band and coupled to the RF input and to the ground node to form a first single magnetic loop antenna which encircles the wrist. The antenna element further comprises a second element positioned near the second outer edge of the band, the second element coupled to the first element and coupled to the RF input and to the ground node to form a second single magnetic loop antenna orthogonal to the first single magnetic loop antenna.

A further aspect of the present invention is a wrist carried selective call receiver comprising a receiver for receiving radio frequency (RF) signals comprising information and for demodulating the RF signals to derive the information. The receiver comprises an RF input, for receiving the radio frequency signals, and a ground node for providing a ground reference for the wrist carried selective call receiver. The selective call receiver further comprises an antenna system comprising first and second antenna elements coupled to the receiver for accepting the RF signals and providing the RF signals to the receiver. The selective call receiver further comprises a non-conducting housing having a first housing section for containing the receiver, and second and third housing sections surrounding the wrist for holding the selective call receiver in place and for containing the first and second antenna elements. The selective call receiver further comprises first and second sets of taps physically coupled to the third housing section and electrically coupled to the second antenna element for adjusting the size of the housing and for electrically coupling the first and second antenna elements. The selective call receiver further comprises a clasp, physically coupled to the second housing section and electrically coupled to the second antenna element, comprising a fastener for physically coupling the second and third housing sections, and first and second conductive contacts separated by an insulating material for electrically coupling the first and second antenna elements to each other. The first antenna element comprises a first strip conductor coupled between the RF input and the first conductive contact of the clasp, and a second strip conductor coupled between the ground node and the second conductive contact of the clasp. The second antenna element comprises a U-shaped strip conductor coupled between the ground node and the first and second sets of taps, a member of each of the first and second sets of taps being physically coupled to the clasp fastener and electrically coupled to the first and second conductive contacts of the clasp to form the antenna system. The first strip conductor and a portion of the U-shaped conductor combine to form a first single magnetic loop antenna having a first physical orientation and coupled between the RF input and the ground node, and the first and second strip conductors and the U-shaped conductor combine to form a second single magnetic loop antenna coupled between the RF input and the ground node. The second single magnetic loop antenna has a second physical orientation substantially orthogonal to the first physical orientation.

Yet another aspect of the present invention is a wrist carried selective call receiver comprising a receiver element for receiving radio frequency (RF) signals comprising information and for demodulating the RF signals to derive the information. The receiver element comprises an RF input for receiving the radio frequency signals, and a ground node for providing a ground reference for the wrist carried selective call receiver. The selective call receiver further comprises an antenna coupled to the receiver element for accepting the RF signals and providing the RF signals to the receiver element. The antenna comprises at least first and second elements, coupled to each other to form a first single magnetic loop antenna having a first physical orientation and coupled between the RF input and the ground node. At least one of the at least first and second elements comprises at least one second single magnetic loop antenna coupled between the RF input and the ground node, and the at least one second single magnetic loop antenna has a second physical orientation different from the first physical orientation. The selective call receiver further comprises a first housing partially surrounding the wrist and enclosing at least the receiver element, a second housing partially surrounding the wrist and enclosing at least the antenna, and at least one expandable third housing for physically and electrically coupling the first and second housings.

Still another aspect of the present invention is a wrist carried selective call receiver comprising a receiver element for receiving radio frequency (RF) signals comprising information and for demodulating the RF signals to derive the information. The receiver element comprises an RF input, for receiving the radio frequency signals, and a ground node for providing a ground reference for the wrist carried selective call receiver. The selective call receiver further comprises an antenna coupled to the receiver element for accepting the RF signals and providing the RF signals to the receiver element. The antenna comprises at least first and second elements, coupled to each other to form a first single magnetic loop antenna having a first physical orientation and coupled between the RF input and the ground node. At least one of the at least first and second elements comprises at least one second single magnetic loop antenna coupled between the RF input and the ground node, the at least one second single magnetic loop antenna having a second physical orientation different from the first physical orientation. The at least first and second elements are enclosed within a non-conducting housing surrounding the wrist. The non-conducting housing comprises at least two separable sections, and at least one disconnectable clasp for physically coupling the at least two separable sections and for electrically coupling the at least first and second elements. The at least one disconnectable clasp comprises a coupling element for electrically coupling a third element to at least one of the at least first and second elements, the coupling element being activated when the at least one disconnectable clasp is in a position that electrically disconnects the at least first and second elements.

DESCRIPTION OF A PREFERRED EMBODIMENT

Figure 1:
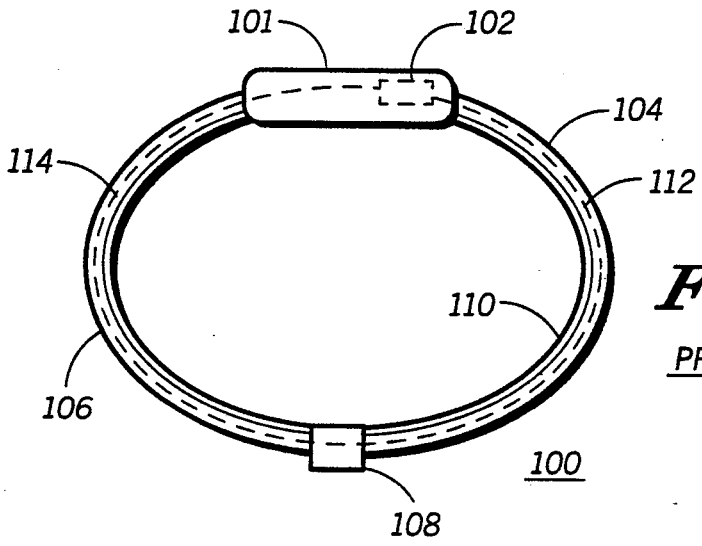
FIG.1 PRIOR ART
FIG. 1 is a side view of a wrist carried receiver having a conventional band antenna design.

With reference to FIG. 1, the antenna used in the previously known wrist carried receiver 100 has been a simple band antenna consisting of first and second strip conductors 112 and 114, housed in the wrist band housings 104 and 106, respectively, the housings being physically coupled to a receiver housing 101. The first and second strip conductors 112 and 114 were coupled electrically to the receiver circuit 102 and to each other via a clasp 108 that also served to hold the wrist carried receiver 100 on the wrist 110 in a comfortable position.

Figure 2:
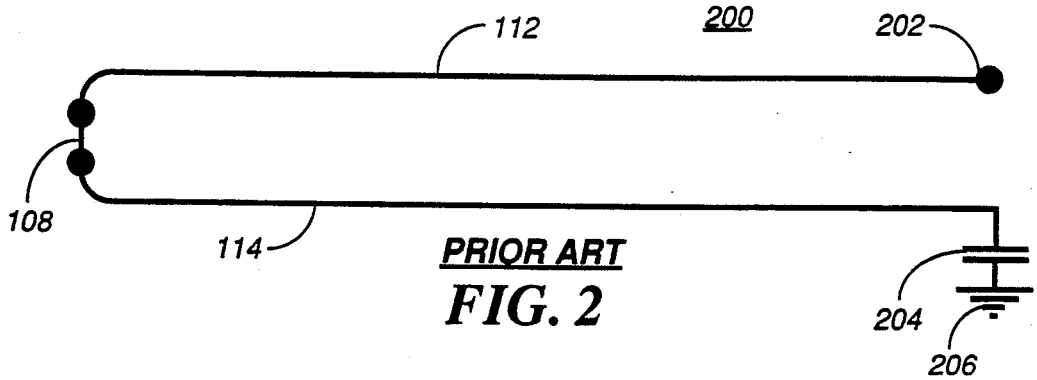
PRIOR ART FIG. 2
FIG. 2 is a schematic diagram of the antenna system of the conventional band antenna design.

The schematic of FIG. 2 shows that the previously known band antenna comprised a single turn magnetic loop antenna formed from the first and second strip conductors 112 and 114 and the clasp 108. One end of the loop antenna was coupled to an RF input 202 of the receiver circuit 102, while the other end of the loop antenna was coupled to a resonating capacitor 204 of the receiver circuit 102, and thence to a ground node 206 of the receiver circuit 102.

While the previously known antenna design of FIG. 1 and FIG. 2 performed well in certain body positions, it performed poorly in other positions. It is well known that a single turn magnetic loop antenna exhibits maximum sensitivity when excited by an RF signal having a magnetic polarization perpendicular to the plane of the loop. It also is well known that a single turn magnetic loop antenna exhibits minimum sensitivity when excited by an RF signal having a magnetic polarization parallel to the plane of the loop. Thus, an antenna design that uses only a single magnetic loop antenna is constrained by the laws of physics to be susceptible to undesirable performance variations related to changes in body position.

Figure 5:
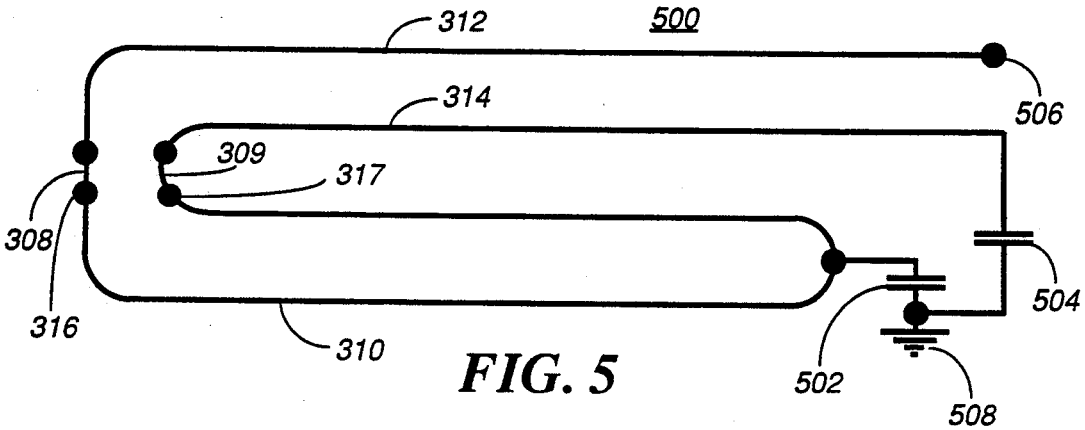
FIG. 5 is a schematic diagram of an antenna design in accordance with the preferred embodiment of the present invention.
Figure 3:
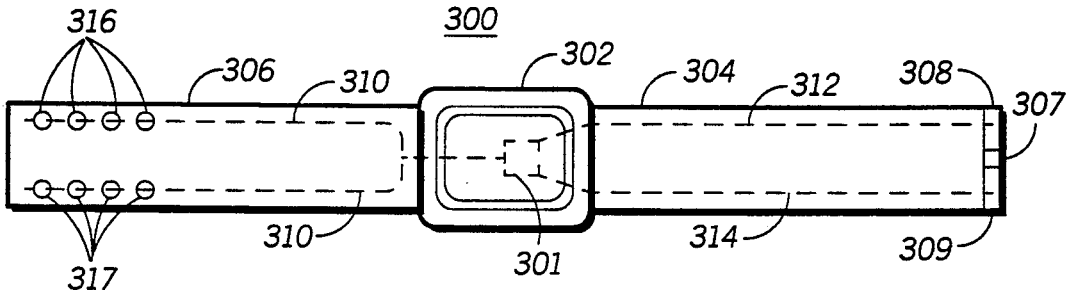
FIG. 3 is a clasp open, top view of a wrist carried receiver having an antenna design in accordance with a preferred embodiment of the present invention.
Figure 4:
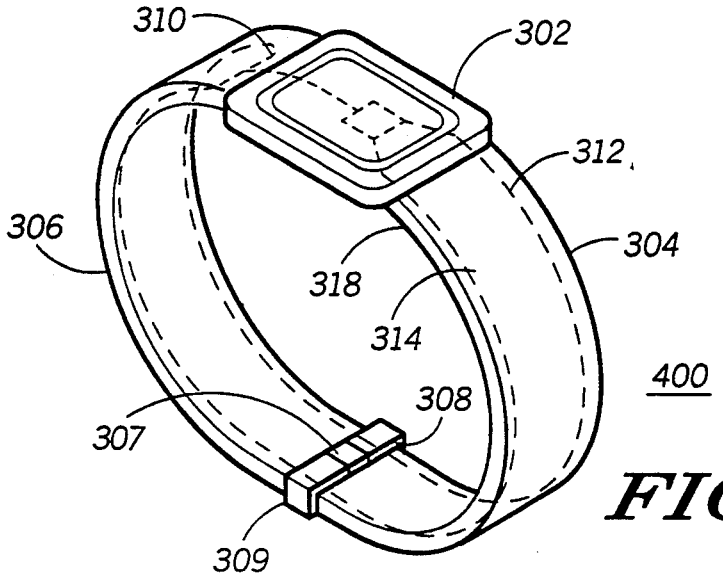
FIG. 4 is a clasp closed, perspective view of a wrist carried receiver having an antenna design in accordance with the preferred embodiment of the present invention.

With reference to FIG. 3, FIG. 4, and FIG. 5, a preferred embodiment of an antenna system according to the present invention overcomes the limitations of previously known band antenna systems. As can be seen from the two views of the wrist carried receiver 300 and 400, and an associated schematic 500, when two conductive clasp sections 308 and 309 and a non-conductive clasp section 307 are closed, wrist element housings 304 and 306, physically coupled to a receiver housing 302, are physically coupled to each other for holding the wrist carried receiver 300 and 400 comfortably on the wrist. As a result of the two conductive clasp sections 308 and 309 of the clasp making electrical contact with two taps 316 and 317, first and second single turn magnetic loop antennae are formed.

The first antenna has maximum sensitivity to a magnetic polarization parallel to an axis through the wrist, the axis being substantially parallel to the forearm. The first antenna comprises a first element 312 having one end coupled to an RF input 506 of a receiver circuit 301. The other end of the first element 312 is coupled to the clasp section 308, and thence to a tap 316. The tap 316 is coupled to one side of a U-shaped second element 310, which is coupled to a first resonating capacitor 502, and thence to a ground node 508 of the receiver circuit 301.

The second antenna has maximum sensitivity to a magnetic polarization perpendicular to an axis through the wrist, the axis being substantially parallel to the forearm. The orientation of the second antenna is thus substantially orthogonal to that of the first antenna. The second antenna comprises the first element 312 having one end coupled to the RF input 506 of the receiver circuit 301. The other end of the first element 312 is coupled to the clasp section 308, and thence to the tap 316. The tap 316 is coupled to the second element 310, which is coupled to a tap 317, located opposite the tap 316, and thence to a clasp section 309. The clasp section 309 is coupled to a third element 314, which is coupled to a second resonating capacitor 504, and thence to the ground node 508.

The advantage of having the first and second orthogonal antennae coupled in parallel between the RF input 506 and the ground node 508 is that for virtually any possible body position, either the first antenna or the second antenna, or both antennae, will be sensitive to the magnetic field of a received RF signal. The resultant antenna system performance thus is less susceptible to undesirable performance variations related to changes in body position.

Figure 6:
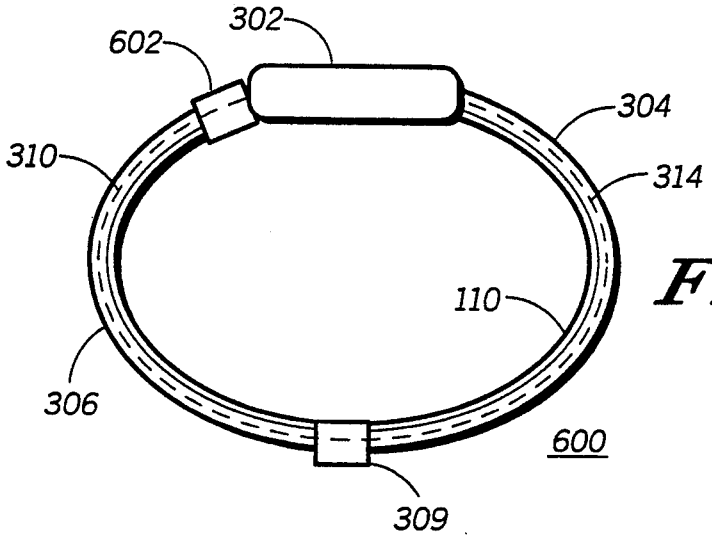
FIG. 6 is a clasp closed, side view of a wrist carried receiver having an antenna design in accordance with a first alternative embodiment of the present invention.
Figure 7:
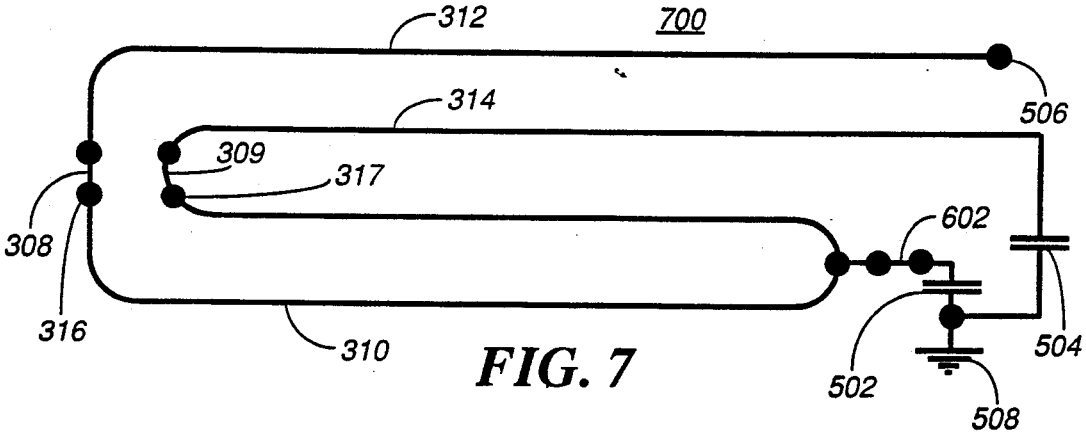
FIG. 7 is a schematic diagram of an antenna design in accordance with the first alternative embodiment of the present invention.

With reference to FIG. 6 and FIG. 7, a first alternative embodiment of a wrist carried receiver 600 and the associated schematic 700 are shown. The essential difference between the alternative embodiment of FIG. 6 and FIG. 7, and the preferred embodiment of the wrist carried receiver 300 and 400, and the associated schematic 500, is the addition of a second clasp 602. The function of the second clasp 602 is to physically couple the wrist element housing 306 to the receiver housing 302, and to electrically couple the second element 310 to the first resonating capacitor 502. This arrangement allows the wrist carried receiver 600 to be removed temporarily from the wrist 110 while maintaining the electrical integrity of the second antenna comprising the first element 312, the clasp section 308, the tap 316, the second element 310, the tap 317, the clasp section 309, the third element 314, and the second resonating capacitor 504.

At the additional expense of requiring the second clasp 602, the first alternative embodiment of a wrist carried receiver 600 performs substantially better with the second clasp 602 open, than does the wrist carried receiver 300 and 400 with the conductive clasp sections 308 and 309 open. This improved performance with the second clasp 602 open is important to any users who have a need to operate the wrist carried receiver 600 while it is removed from the wrist 110 and in an unclasped condition.

Figure 8:
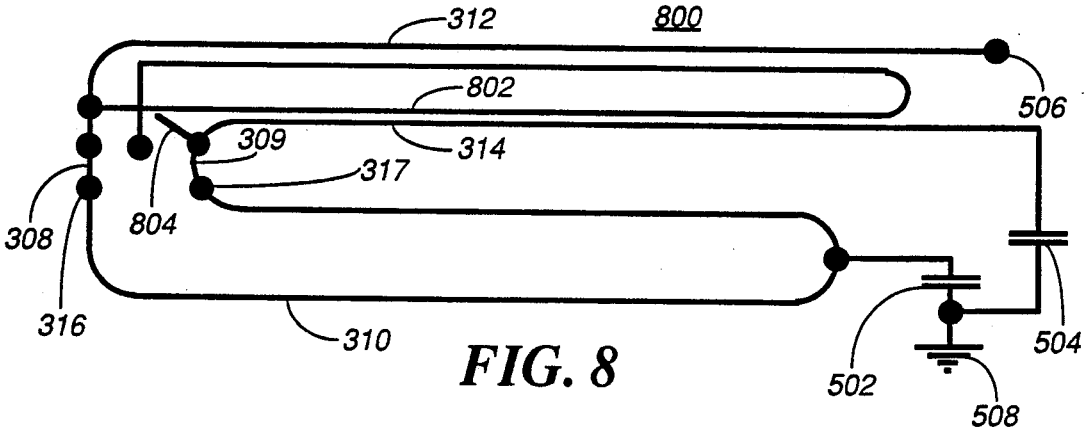
FIG. 8 is a schematic diagram of an antenna design in accordance with a second alternative embodiment of the present invention.

With reference to FIG. 8, the essential differences between a schematic 800 for a second alternative embodiment and the schematic 500 of the preferred embodiment are the addition of a new antenna element 802 and a new switch 804 that closes electrically when the clasp sections 307, 308, and 309 are opened physically. The function of the new antenna element 802 and the switch 804 is to maintain the electrical characteristics of the original second antenna comprising the first element 312, the clasp section 308, the tap 316, the second element 310, the tap 317, the clasp section 309, the third element 314, and the resonating capacitor 504, when the clasp sections 307, 308, and 309 are opened.

The electrical characteristics of the original second antenna can be maintained by making the length of the new antenna element 802 such that the inductance of the new antenna element 802 is equal to the inductance of the components that are disconnected when the clasp sections 307, 308, and 309 are open. These components include the clasp section 308, the tap 316, the second element 310, the tap 317, and the clasp section 309. By keeping the inductance of the new antenna formed by the first element 312, the new antenna element 802, the switch 804, and the third element 314, the same as that of the original second antenna, the resonant frequency of the antenna in combination with the second resonating capacitor 504 remains unchanged. This allows the new antenna formed when the clasp is opened to maintain approximately the same electrical characteristics as those of the original second antenna. This second alternative embodiment offers improved performance when the clasp sections 307, 308, and 309 are open, which as discussed earlier is important to any users who have a need to operate the wrist carried receiver 600 while it is removed from the wrist 110 and in an unclasped condition.

Figure 9:
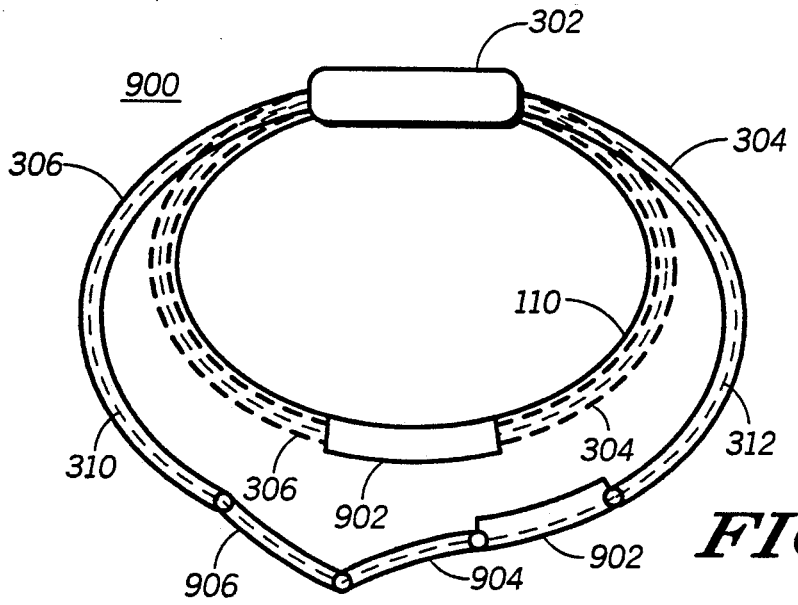
FIG. 9 is a side view of a wrist carried receiver having an antenna design in accordance with a third alternative embodiment of the present invention, showing the clasp in both open and closed positions.
Figure 10:
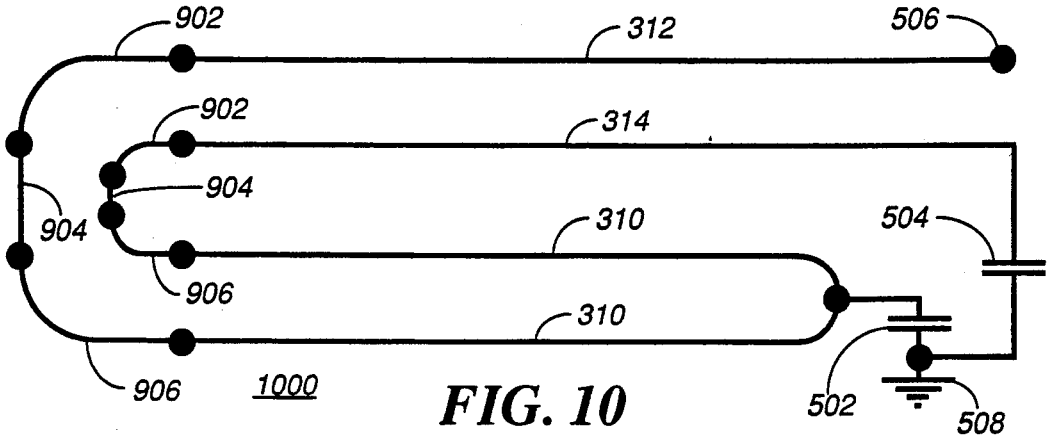
FIG. 10 is a schematic diagram of an antenna design in accordance with the third alternative embodiment of the present invention.

With reference to FIG. 9 and FIG. 10, a third alternative embodiment of a wrist carried receiver 900 and associated schematic 1000 is depicted. The third alternative embodiment of a wrist carried receiver 900 differs physically from the preferred embodiment of the wrist carried receiver 300 and 400, in that the wrist carried receiver 900 comprises a folding clasp 902, 904, and 906, which maintains the electrical integrity of both the first and second magnetic loop antennae throughout all positions of the clasp. This fact allows the wrist carried receiver 900 to be removed from the wrist without requiring the electrical opening of either the first or the second magnetic loop antenna, while maintaining low susceptibility to performance variations related to changes in body position, as discussed earlier.

Figure 11:
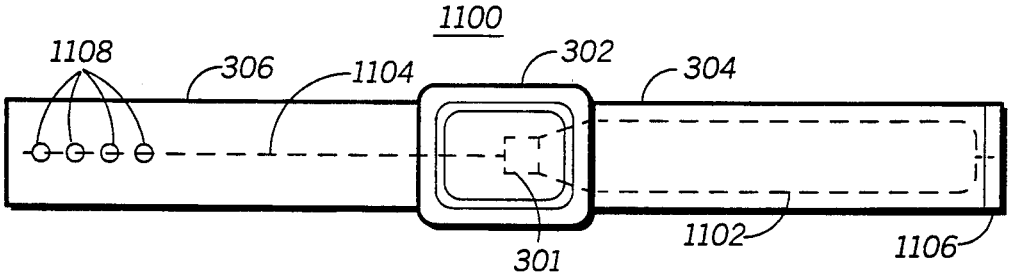
FIG. 11 is a clasp open, top view of a wrist carried receiver having an antenna design in accordance with a fourth alternative embodiment of the present invention.
Figure 12:
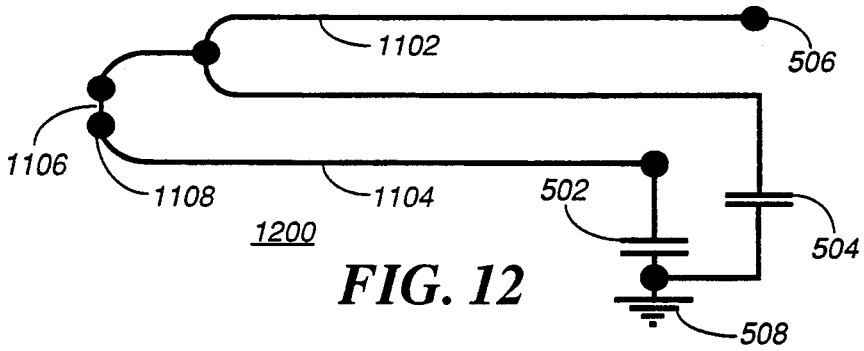
FIG. 12 is a schematic diagram of an antenna design in accordance with the fourth alternative embodiment of the present invention.

With reference to FIG. 11 and FIG. 12, a fourth alternative embodiment of a wrist carried receiver 1100 and associated schematic 1200 comprises a U-shaped first element 1102 in one wrist element housing 304, and a linear strip conductor second element 1104 in the other wrist element housing 306. The first element 1102 forms a first magnetic loop antenna coupled between the RF input 506 and the second resonating capacitor 504. A second magnetic loop antenna, orthogonal to the first magnetic loop antenna, comprises a portion of the first element 1102 and the second element 1104, coupled to each other by a clasp 1106 and a tap 1108, the second magnetic loop antenna being coupled between the RF input 506 and the first resonating capacitor 502. This embodiment of the wrist carried receiver 1100 provides an advantage in that it maintains the electrical integrity of the first magnetic loop antenna even when the clasp 1106 is open. Additionally, in accordance with the present invention, the embodiment depicted in FIG. 11 and FIG. 12 provides improved performance of the wrist carried receiver 1100 when worn on the wrist because it provides first and second single turn magnetic loop antennae that are orthogonal to one another.

Figure 13:
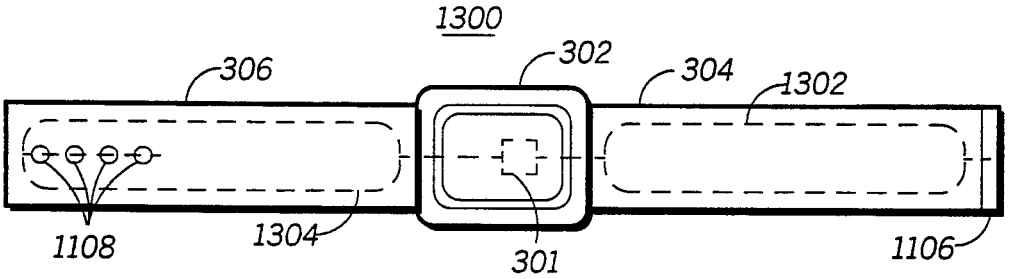
FIG. 13 is a clasp open, top view of a wrist carried receiver having an antenna design in accordance with a fifth alternative embodiment of the present invention.
Figure 14:
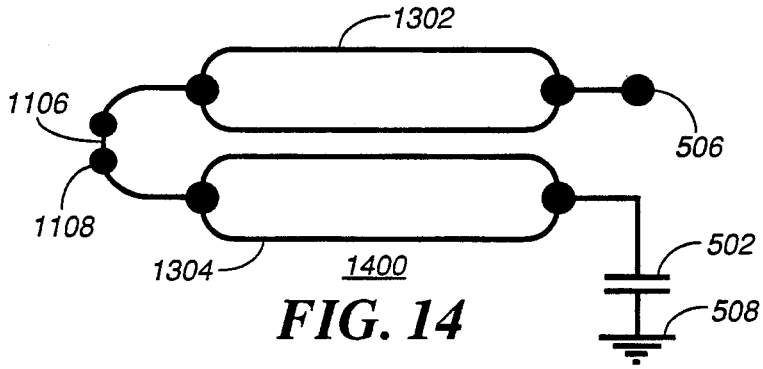
FIG. 14 is a schematic diagram of an antenna design in accordance with the fifth alternative embodiment of the present invention.

With reference to FIG. 13 and FIG. 14, a fifth alternative embodiment of a wrist carried receiver 1300 and associated schematic 1400 comprises a loop-shaped first element 1302 in one wrist element housing 304, and a loop-shaped second element 1304 in the other wrist element housing 306. The first element 1302 forms a first magnetic loop antenna coupled between the RF input 506 and the clasp 1106. The second element 1304 forms a second magnetic loop antenna coupled between the first resonating capacitor 502 and a tap 1108. The first and second magnetic loop antennae are coupled to each other in series between the RF input 506 and the first resonating capacitor 502 when the clasp 1106 is coupled to the tap 1108. The coupled elements of the first and second magnetic loop antennae also form a third magnetic loop antenna orthogonal to the first and second magnetic loop antennae, and coupled between the RF input 506 and the first resonating capacitor 502. The advantage provided by the fifth alternative embodiment of a wrist carried receiver 1300 is that only the first resonating capacitor 502 is required. The second resonating capacitor 504, used by the preceding embodiments according to the present invention, is not required in the fifth alternative embodiment of a wrist carried receiver 1300. This reduces cost and saves space in the receiver housing 302.

Figure 15:
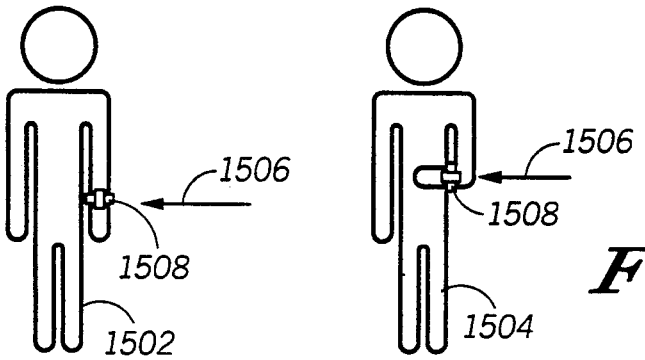
FIG. 15 is a sketch showing body positions that were used during antenna performance evaluations.

With reference to FIG. 15, two body positions 1502 and 1504 for a wrist carried receiver 1508 are shown for which wrist carried receivers have been tested. As was discussed earlier, a wrist carried receiver is operated in many different positions. A wrist carried receiver thus must be designed for acceptable receive sensitivity in many possible body positions.

For carrying out a test of a wrist carried receiver's susceptibility to variations in sensitivity caused by changes in position, a test signal is transmitted from a single source and has a magnetic polarization 1506 that is directed in a horizontal plane. A test subject wears the wrist carried receiver 1508 in the first and second positions 1502 and 1504, while the receiver sensitivity is measured in several different azimuth positions. (Azimuth is defined as the angle in degrees between a first vertical plane parallel to the direction the test subject is facing and a second vertical plane that includes the center of the test subject and the center of the source of the transmitted test signal, and measured such that the azimuth is zero when the test subject is facing the source.) As can be seen from FIG. 15, the first and second positions 1502 and 1504 are orthogonal to one another, and, when measured over a multiplicity of azimuth positions, comprise a valid test of the receiver's susceptibility to variations in sensitivity caused by changes in position.

Figure 16:
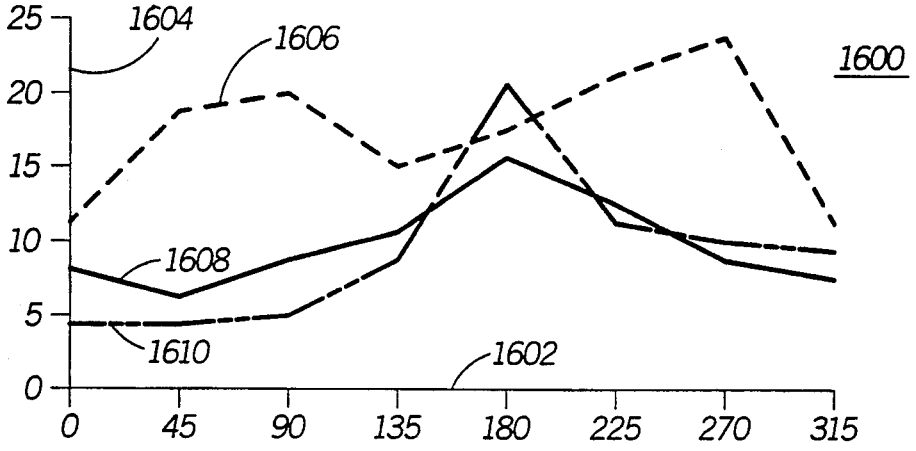
FIG. 16 is a graph showing average receiver sensitivity for three different antenna designs in eight different orientations.

With reference to FIG. 16, a graph 1600 shows performance data for a wrist carried selective call receiver, using three representative antenna designs. A vertical scale 1604 indicates a two-position average receiver sensitivity in microvolts per meter required for eighty percent successful page reception, using the first and second positions 1502 and 1504 of FIG. 15, while a horizontal scale indicates azimuth.

A curve 1606 shows test data for the previously known wrist carried receiver 100 (FIG. 1). A curve 1608 shows test data for the fourth alternative embodiment of the wrist carried receiver 1100 (FIG. 11) according to the present invention. A curve 1610 shows test data for the preferred embodiment of the wrist carried receiver 300 (FIG. 3) according to the present invention. Data points on the curves 1606, 1608, and 1610 represent the two-position average receiver sensitivity measured for azimuth positions every forty-five degrees throughout one complete three-hundred-sixty degree rotation. The graph 1600 clearly shows superiority in the performance of wrist carried receivers having antenna systems according to the present invention, over the performance of a wrist carried receiver having a conventional band antenna.

Figure 17:
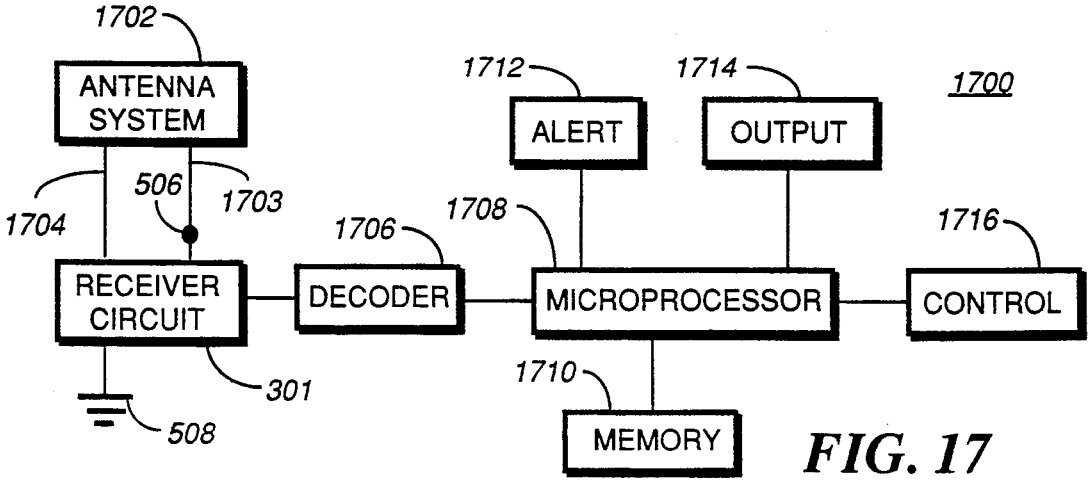
FIG. 17 is a block diagram of a selective call receiver in accordance with an embodiment of the present invention.

With reference to FIG. 17, a selective call receiver 1700 comprises an antenna system 1702 in accordance with the present invention, for accepting RF signals. A line 1703 couples the antenna system 1702 to the RF input node 506 of the receiver circuit 301, which receives the RF signals accepted and has the ground node 508. A line 1704 couples the antenna system 1702 to the ground node 508 of the receiver circuit 301. A decoder 1706 is coupled to the receiver circuit 301 for decoding received information. A microprocessor 1708 receives the decoded received information from the decoder 1706 and processes the information to recover messages. The microprocessor 1708 is coupled to a memory 1710 for storing the messages received, and the microprocessor 1708 controls the storing and recalling of the messages. An alert device 1712 provides an audible or tactile alert to the user when the microprocessor 1708 has a message ready for presentation. There is an output device 1714 comprising a visual display or a speaker, the output device also being controlled by the microprocessor 1708. A control section 1716 comprises user accessible controls for allowing the user to command the microprocessor 1708 to perform the selective call receiver operations well known to those skilled in the art and typically includes control switches such as an on/off control button, a function control, and so forth.

In view of the preceding discussion, it should be clear that the preferred embodiment of a wrist carried receiver according to the present invention comprises a superior antenna system that eliminates the space consuming ferrite core loop antenna while maintaining the antenna system's performance in the many body positions possible while the receiver is being worn on the wrist. Also discussed were alternative embodiments of a wrist carried receiver according to the present invention that additionally minimize reduction of antenna system performance while the wrist carried receiver is removed from the wrist with the clasp left open.

We claim:

1. An antenna system for a wrist carried selective call receiver comprising a non-conducting housing formed as a substantially cylindrical band for surrounding the wrist, the band delimited by first and second outer edges, the antenna system comprising:

first means for coupling to a radio frequency (RF) input of the selective call receiver;

second means for coupling to a ground node of the selective call receiver;

a first element positioned near the first outer edge of the band and coupled to the first means and to the second means to form a first single magnetic loop antenna which encircles the wrist; and a second element positioned near the second outer edge of the band, the second element coupled to the first element and coupled to the first means and to the second means to form a second single magnetic loop antenna orthogonal to the first single magnetic loop antenna.

2. The antenna system according to claim 1, wherein the first and second elements are enclosed within the non-conducting housing.

3. The antenna system according to claim 1, wherein the first and second elements comprise a strip conductor.

4. The antenna system according to claim 1, wherein the second element is coupled to the first means and to the second means to form a third single magnetic loop antenna which encircles the wrist.

5. A wrist carried selective call receiver having a non-conducting housing formed as a substantially cylindrical band for surrounding the wrist, the band delimited by first and second outer edges, the selective call receiver comprising:

receiver means for receiving radio frequency (RF) signals comprising information and for demodulating the RF signals to derive the information, the receiver means comprising:

an RF input for receiving the radio frequency signals; and a ground node for providing a ground reference for the wrist carried selective call receiver; and antenna means coupled to the receiver means for accepting the RF signals and providing the RF signals to the receiver means, the antenna means comprising:

a first element positioned near the first outer edge of the band and coupled to the RF input and to the ground node to form a first single magnetic loop antenna which encircles the wrist; and a second element positioned near the second outer edge of the band, the second element coupled to the first element and coupled to the RF input and to the ground node to form a second single magnetic loop antenna orthogonal to the first single magnetic loop antenna.

6. The wrist carried selective call receiver according to claim 5, wherein the first and second elements are enclosed within the non-conducting housing.

7. The wrist carried selective call receiver according to claim 6, wherein the non-conducting housing comprises:

at least two non-expandable elements, and at least one expandable element for physically coupling the at least two non-expandable elements and for electrically closing the first single magnetic loop antenna.

8. The wrist carried selective call receiver according to claim 7, wherein the at least one expandable element comprises:

physical coupling means coupled to the at least two non-expandable elements for holding the selective call receiver in place on the wrist when the physical coupling means is in a non-expanded position, and for releasing the selective call receiver from the wrist when the physical coupling means is in an expanded position; and electrical coupling means coupled to the physical coupling means for maintaining the electrical closing of the first single magnetic loop antenna without interruption in both the non-expanded position and the expanded position.

9. The wrist carried selective call receiver according to claim 6, wherein the non-conducting housing comprises:

at least two separable housing elements, and at least one disconnectable clasp for physically coupling the at least two separable housing elements and for electrically closing the first single magnetic loop antenna.

10. The wrist carried selective call receiver according to claim 9, wherein the at least one disconnectable clasp in a first position electrically closes the first single magnetic loop antenna, and in a second position electrically opens the first single magnetic loop antenna without electrically opening the second single magnetic loop antenna.

11. The wrist carried selective call receiver according to claim 5, wherein the first and second elements comprise a strip conductor.

12. The wrist carried selective call receiver according to claim 5, wherein the second element is coupled to the RF input and to the ground node to form a third single magnetic loop antenna which encircles the wrist.

13. The wrist carried selective call receiver according to claim 5, comprising:

a non-conducting first housing element surrounding the wrist and enclosing the first and second elements;

a second housing element enclosing the receiver means; and a disconnectable clasp for physically coupling the first and second housing elements and for electrically coupling the first and second elements to a node of the selective call receiver.

14. The wrist carried selective call receiver according to claim 13, wherein the disconnectable clasp in a first position coupled the first and second elements to a node of the selective call receiver, and in a second position electrically opens the first single magnetic loop antenna without electrically opening the second single magnetic loop antenna.

15. A wrist carried selective call receiver comprising:

a receiver for receiving radio frequency (RF) signals comprising information and for demodulating the RF signals to derive the information, the receiver comprising:

an RF input, for receiving the radio frequency signals; and a ground node for providing a ground reference for the wrist carried selective call receiver;

an antenna system comprising first and second antenna elements coupled to the receiver for accepting the RF signals and providing the RF signals to the receiver;

a non-conducting housing comprising a first housing section for containing the receiver, and second and third housing sections surrounding the wrist for holding the selective call receiver in place and for containing the first and second antenna elements;

first and second steps of taps physically coupled to the third housing section and electrically coupled to the second antenna element for adjusting the size of the housing and for electrically coupling the first and second antenna elements; and a clasp, physically coupled to the second housing section and electrically coupled to the second antenna element, comprising a fastener for physically coupling the second and third housing sections, the first and second conductive contacts separated by an insulating material for electrically coupling the first and second antenna elements to each other, wherein the first antenna element comprises:

a first strip conductor coupled between the RF input and the first conductive contact of the clasp; and a second strip conductor coupled between the ground node and the second conductive contact of the clasp, and wherein the second antenna element comprises a U-shaped strip conductor coupled between the ground node and the first and second sets of taps, a member of each of the first and second sets of taps being physically coupled to the clasp fastener and electrically coupled to the first and second conductive contacts of the clasp to form the antenna system, and wherein the first strip conductor and a portion of the U-shaped conductor combine to form a first single magnetic loop antenna having a first physical orientation and coupled between the RF input and the ground node, and wherein the first and second strip conductors and the U-shaped conductor combine to form a second single magnetic loop antenna coupled between the RF input and the ground node, the second single magnetic loop antenna having a second physical orientation substantially orthogonal to the first physical orientation.

16. A wrist carried selective call receiver comprising:

receiver means for receiving radio frequency (RF) signals comprising information and for demodulating the RF signals to derive the information, the receiver means comprising:

an RF input, for receiving the radio frequency signals; and a ground node for providing a ground reference for the wrist carried selective call receiver;

antenna means coupled to the receiver means for accepting the RF signals and providing the RF signals to the receiver means, the antenna means comprising at least first and second elements, coupled to each other to form a first single magnetic loop antenna having a first physical orientation and coupled between the RF input and the ground node, wherein at least one of the at least first and second elements comprises at least one second single magnetic loop antenna coupled between the RF input and the ground node, the at least one second single magnetic loop antenna having a second physical orientation different from the first physical orientation;

a first housing partially surrounding the wrist and enclosing at least the receiver means;

a second housing partially surrounding the wrist and enclosing at least the antenna means; and at least one expandable third housing for physically and electrically coupling the first and second housings.

17. The wrist carried selective call receiver according to claim 16, wherein the at least one expandable third housing comprises:

physical coupling means coupled to the first and second housings for holding the selective call receiver in place on the wrist when the physical coupling means is in a non-expanded position, and for releasing the selective call receiver from the wrist when the physical coupling means is in at least one expanded position; and electrical means coupled to the physical coupling means for maintaining the electrical coupling between the receiver means and the antenna means without interruption throughout the entirety of the non-expanded position and the at least one expanded position.

18. A wrist carried selective call receiver comprising:

receiver means for receiving radio frequency (RF) signals comprising information and for demodulating the RF signals to derive the information, the receiver means comprising:

an RF input, for receiving the radio frequency signals; and a ground node for providing a ground reference for the wrist carried selective call receiver; and antenna means coupled to the receiver means for accepting the RF signals and providing the RF signals to the receiver means, the antenna means comprising at least first and second elements, coupled to each other to form a first single magnetic loop antenna having a first physical orientation and coupled between the RF input and the ground node, wherein at least one of the at least first and second elements comprises at least one second single magnetic loop antenna coupled between the RF input and the ground node, the at least one second single magnetic loop antenna having a second physical orientation different from the first physical orientation, wherein the at least first and second elements are enclosed within a non-conducting housing surrounding the wrist, and wherein the non-conducting housing comprises:

at least two separable sections, and at least one disconnectable clasp for physically coupling the at least two separable sections and for electrically coupling the at least first and second elements, and wherein the at least one disconnectable clasp comprises means for electrically coupling a third element to at least one of the at least first and second elements, the means being activated when the at least one disconnectable clasp is in a position that electrically disconnects the at least first and second elements.

* * * * *